United States Patent [19]

Nishikawa et al.

[11] Patent Number: 5,068,629

[45] Date of Patent: Nov. 26, 1991

[54] NONRECIPROCAL CIRCUIT ELEMENT

[75] Inventors: Toshio Nishikawa, Nagaokakyo; Takekazu Okada, Kyoto; Hiroki Dejima, Uji; Hiromu Tokudera, Kyoto, all of Japan

[73] Assignee: Murata Manufacturing Co., Ltd., Japan

[21] Appl. No.: 519,266

[22] Filed: May 2, 1990

Related U.S. Application Data

[63] Continuation of Ser. No. 445,913, Dec. 4, 1989, abandoned, which is a continuation of Ser. No. 254,459, Oct. 6, 1988, abandoned.

[30] Foreign Application Priority Data

Oct. 7, 1987 [JP] Japan ..... 62-253956
Aug. 25, 1988 [JP] Japan ..... 63-211200

[51] Int. Cl.[5] ..... H01P 1/36; H01P 1/387
[52] U.S. Cl. ..... 333/1.1; 333/24.2
[58] Field of Search ..... 333/1.1, 24.2

[56] References Cited

U.S. PATENT DOCUMENTS 3,605,040 9/1971 Knerr et al. ..... 333/1.1
3,818,381 6/1974 Kouishi et al. ..... 333/24.2 X

FOREIGN PATENT DOCUMENTS 60-194803 10/1985 Japan .

*Primary Examiner*—Paul Gensler
*Attorney, Agent, or Firm*—Ostrolenk, Faber, Berg & Soffen

[57] ABSTRACT

A nonreciprocal circuit element including a ferrite assembly which ha a pair of ferrite members and a plurality of central conductors interposed between the ferrite members, and a dielectric substrate which has an earthing electrode formed on one of its faces and a plurality of impedance matching electrodes formed on the other face, and wherein a direct current magnetic field is applied to the ferrite members. The ferrite assembly and the dielectric substrate are stacked such that lead-out portions of the central conductors are, respectively, connected to the impedance matching electrodes, while earthing portions of the central conductors and the earthing electrode are grounded.

22 Claims, 5 Drawing Sheets

NONRECIPROCAL CIRCUIT ELEMENT

This is a continuation of application Ser. No. 07/445,913, filed on Dec. 4, 1989, which is a continuation of application Ser. No. 07/254,459 filed on Oct. 6, 1988, both now abandoned.

BACKGROUND OF THE INVENTION

The present invention generally relates to a nonreciprocal circuit element of a lumped constant type such as an isolator or a circulator which are employed in high-frequency components having a frequency band in the VHF, UHF and microwave ranges and more particularly, to a nonreciprocal circuit element which can be made compact without increasing its production cost. Since the present invention is preferably applicable to an isolator employed in, for example, a mobile telephone system, a prior art isolator in a mobile telephone system will be described as one example, hereinbelow.

The mobile telephone system of this example is a mobile telephone system which can carry out transmission and reception in the same manner as general fixed telephone sets by using radio waves in a band ranging, for example, from 800 to 900 MHZ. As shown in FIG. 1, this mobile telephone system is constituted by mobile telephone equipment generally designated 50, an antenna 51 used for both transmitting signals and receiving signals in common, and a telephone set 52. The mobile telephone equipment 50 includes a transmitter 53, a receiver 54, a controller 55 and a duplexer 56. The controller 55 is provided for giving commands for effecting transmission between the mobile telephone system and base stations, changeover of channels, etc. The duplexer 56 is provided not only for preventing interference between the transmitted signals and the received signals but also for preventing interference signals, from being emitted externally. An isolator 57 for preventing reflection of transmitted RF power is provided between the transmitter 53 and the duplexer 56. The function of the isolator 57 is to pass signals with very slight attenuation in a direction from the transmitter to the duplexer but to greatly attenuate signals in the opposite direction and is an indispensable component for the mobile telephone system.

The known isolator 57 has a construction as shown in, for example, FIGS. 2 and 3. In FIGS. 2 and 3, an isolator 30 includes a metallic casing 31 acting as an outer conductor and having a shape of a rectangular parallelepiped, an earth plate 32 made of copper, and a substrate 33 made of alumina. The substrate 33 is placed on the earth plate 32 which in turn is on the bottom of the casing 31. The substrate 33 is formed, at its central portion, with a hole 33A. A ferrite assembly 34 is inserted into the hole 33A. A permanent magnet 35 is bonded to an inner face of an upper wall of the casing 31.

The ferrite assembly 34 includes a pair of upper and lower ferrite members **34*a* and 34*b*. Central conductors 37*a*, 37*b* and 37*c* are provided between the upper and lower ferrite members 34*a* and 34*b* so as to intersect with one another at an angle of 120° and such that the central conductors 37*c* and 37*a* confront the upper and lower ferrite members 34*a* and 34*b*, respectively. Furthermore, two insulating sheets 36 are, respectively, inserted between the central conductors 37*a* and 37*b* and between the conductors 37*b* and 37*c*. An earth piece 37*d* is integrally formed with the central conductors 37*a*, 37*b* and 37*c*. A bottom face of the lower ferrite member 34*b* is connected, through the earth piece 37*d*, to the earth plate 32. Distal ends (lead-out portions) of the central conductors 37*a*, 37*b* and 37*c* are, respectively, connected to capacitor electrodes 38*a*, 38*b* and 38*c* formed on peripheral portions of an upper face of the substrate 33. The capacitor electrodes 38*a*, 38*b* and 38*c* act as elements for impedance matching. A contact piece 37*e* extends upward from each of the central conductors 37*a*, 37*b* and 37*c* and is fitted into each of the holes of an earth plate 39 provided on an upper face of the upper ferrite member 34*a* so that all three contact pieces 37*e* are connected to the earth plate 39. Thus, the earth plate 39 is connected to the earth plate 32 so as to assume earth potential. Meanwhile, the capacitor electrode 38*c* is connected, via a film resistor 40, to an earthing electrode 38*d* for the substrate 33 by a through-hole electrode 41. The remaining capacitor electrodes 38*a* and 38*b* are led outwardly by external terminals 42**, respectively.

FIG. 4 shows an equivalent circuit of the isolator 30. For example, a signal inputted to a terminal A is passed through only a terminal B, while a signal flowing in a direction from the terminal B towards the central conductor is absorbed, through its conversion into heat, by the film resistor 40.

Since the mobile telephone equipment, the telephone set, etc. are required to be loaded into a small cabin, there is a keen demand that the mobile telephone system be made as compact as possible. In accordance with this demand for compactness of the mobile telephone system, there is a demand that the isolator be also made more compact. As a way to meet this demand for compactness of the mobile telephone system, a possible reduction in the diameter of, for example, the ferrite members has been considered. However, if this is done, electrical characteristics of the isolator are aggravated. Therefore, it is not desirable for the ferrite members to be made smaller in diameter.

SUMMARY OF THE INVENTION

Accordingly, an essential object of the present invention is to provide a nonreciprocal circuit element acting as an isolator, which is made compact without aggravation of the electrical characteristics of the isolator.

In order to make the nonreciprocal circuit element compact without reducing the diameter of the ferrite members, the present inventors have directed their attention to the dielectric substrate. Namely, in the known isolator referred to above, since the capacitor electrodes are formed at the peripheral portions of the dielectric substrate, the surface area of the dielectric substrate is enlarged. Thus, the present inventors have noticed that if this extension of the area of the dielectric substrate to the peripheral portions is eliminated, the area of the dielectric substrate can be reduced accordingly and therefore, the nonreciprocal circuit element can be made compact.

In order to accomplish this object of the present invention, a nonreciprocal circuit element embodying the present invention comprises: a ferrite assembly which includes at least one ferrite member and a plurality of central conductors; said central conductors being electrically insulated from one another and intersecting one another; said central conductors each having a lead-out portion and an earthing portion; and a dielectric substrate which has an earthing electrode formed on one face thereof and has a plurality of impedance matching electrodes formed on the other face thereof; said ferrite assembly and said dielectric substrate being stacked such that said lead-out portions of said central conductors are, respectively, connected to said impedance matching electrodes; said earthing portions of said central conductors and said earthing electrode of said dielectric substrate being grounded; wherein a direct current magnetic field is applied to said ferrite members.

In the nonreciprocal circuit element of the present invention, in order to supply a direct current magnetic field to the ferrite members, it is possible to provide a permanent magnet on an inner face of a top wall of a casing made of magnetic material in a known manner. Alternatively, it can also be so arranged that the permanent magnet is provided on an inner face of a bottom wall of the casing such that the ferrite assembly and the dielectric substrate are placed on the permanent magnet.

In the nonreciprocal circuit element of the present invention, the dielectric substrate formed with the capacitor electrodes and the ferrite assembly are stacked. Thus, an undesirable phenomenon of known nonreciprocal circuit elements can be eliminated, namely that in the prior art elements, the capacitor electrodes are provided at outer peripheral portions of the dielectric substrate, which are located outwardly of the ferrite members, so that the dielectric substrate is extended outwardly. In contrast, in the present invention, since the size of the dielectric substrate can be reduced, the nonreciprocal circuit element can be made compact without decreasing the diameter of the ferrite members and thus, the electrical characteristics of the nonreciprocal circuit element are not aggravated.

In accordance with another aspect of the present invention, since a function of an earth plate for the known ferrite assembly is imparted to the earthing electrode on the dielectric substrate, this known earth plate can be eliminated and thus, the number of components of the nonreciprocal circuit element can be reduced accordingly.

Furthermore, in accordance with the present invention, in the case where the permanent magnet is provided on the inner face of the bottom wall of the casing, not only can the frequency be adjusted easily after assembly of the components of the nonreciprocal circuit element, but also the number of the manufacturing steps required to make the nonreciprocal circuit element can be reduced, in comparison with a case where the permanent magnet is bonded to the inner face of the top wall of the casing.

BRIEF DESCRIPTION OF THE DRAWINGS

Objects and features of the present invention will become apparent from the following description of preferred embodiments thereof with reference to the accompanying drawings, in which.

Before the description of the present invention proceeds, it is to be noted that like parts are designated by like reference numerals throughout the several views of the accompanying drawings.

DETAILED DESCRIPTION OF PREFERRED EMBODIMENTS OF THE INVENTION

Figure 5:
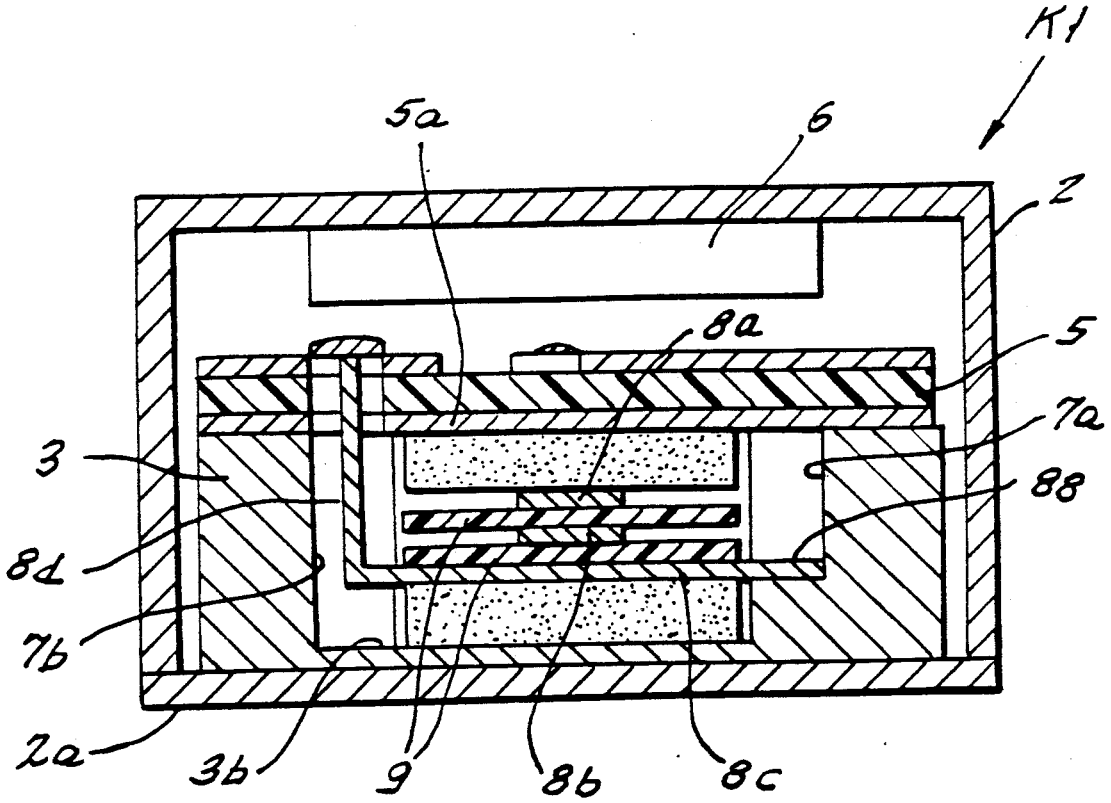
FIG. 5 is a sectional view of a lumped constant type isolator according to a first embodiment of the present invention.
Figure 6:
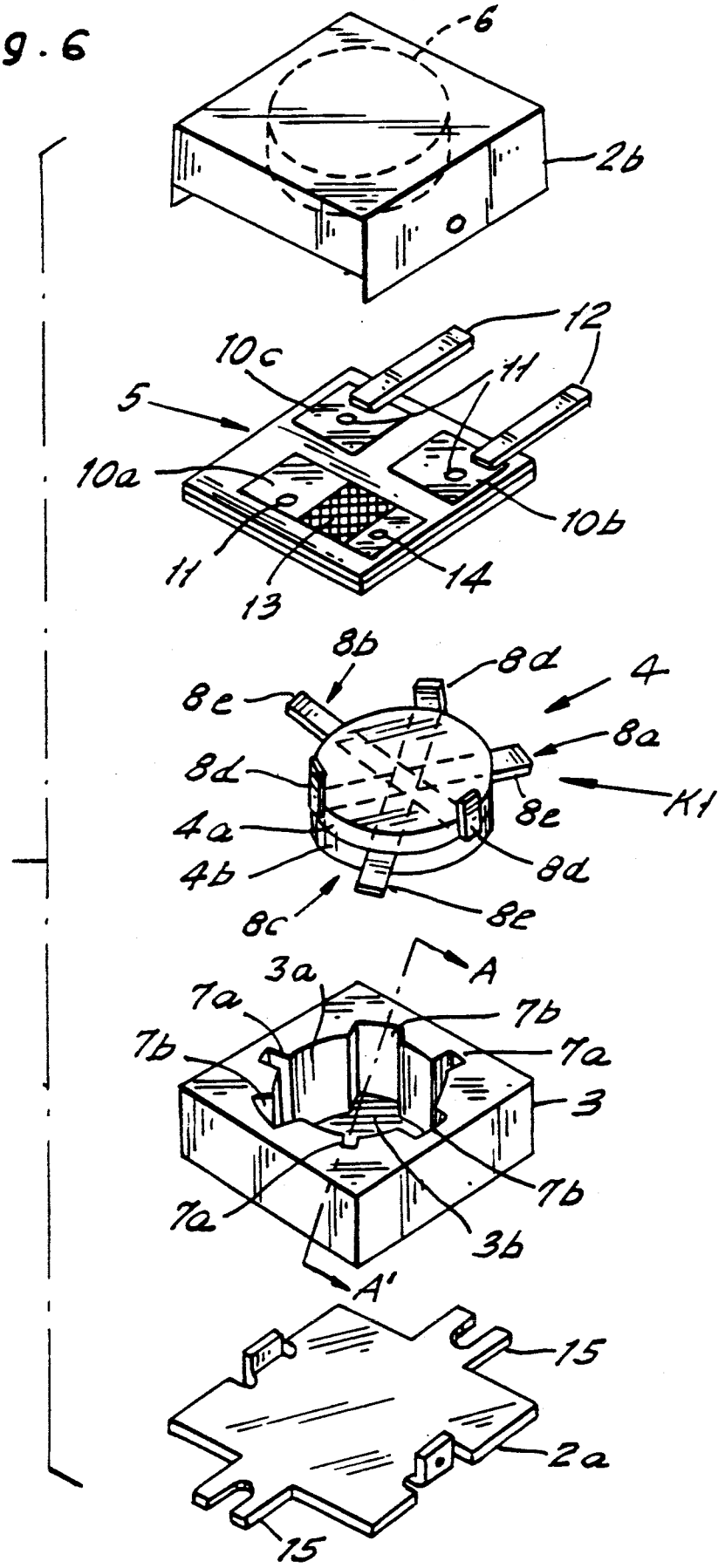
FIG. 6 is an exploded perspective view of the isolator of FIG. 5.

Referring now to the drawings, there is shown in FIGS. 5 and 6, a lumped constant type isolator K1 according to a first embodiment of the present invention. The isolator K1 includes a casing 2 having a shape of a rectangular parallelepiped. The casing 2 has a bottom plate 2*a* and a cover portion 2*b* which are mainly plated with nickel. In the casing 2, an earthing block 3 made of copper and formed by metal sheet working is soldered to an upper face of the bottom plate 2*a*. A ferrite assembly 4 and a dielectric substrate 5 are sequentially stacked on the earthing block 3. Furthermore, a permanent magnet 6 is bonded to an inner face of the cover portion 2*b* so as to be disposed above the dielectric substrate 5.

The earthing block 3 is formed, at its central portion, with a hollow 3*a* for receiving the ferrite assembly 4. Three earthing slots 7*a* and three recessed grooves 7*b* are alternately formed at the periphery of the hollow 3*a* at intervals of 60°. The earthing slots 7*a* are provided at intervals of 120° and the recessed grooves 7*b* are provided at intervals of 120°.

In the ferrite assembly 4, three central conductors 8*a*, 8*b* and 8*c* are provided so as to intersect with one another at angles of 120° and two insulating sheets 9 are disposed between the central conductors 8*a* and 8*b* and between the central conductors 8*b* and 8*c*, respectively. The central conductors 8*a*, 8*b* and 8*c* and the insulating sheets 9 which are provided between the neighboring ones of the central conductors 8*a*, 8*b* and 8*c* are interposed between a pair of upper and lower ferrite members 4*a* and 4*b* such that each of the central conductors 8*a*, 8*b* and 8*c* has two opposite ends which are projected outwardly from the upper and lower ferrite members 4*a* and 4*b*. Alternatively, it is also possible to eliminate one of the upper and lower ferrite members 4*a* and 4*b*. An earthing portion 8*e* is provided at one end of each of the central conductors 8*a*, 8*b* and 8*c* and is soldered into a respective one of the earthing slots 7*a*. A lead-out portion 8*d* is provided at the other end of each of the central conductors 8*a*, 8*b* and 8*c*. The lead-out portions 8*d* are bent upwardly and are disposed in respectives ones of the recessed grooves 7*b* so as to be held out of contact with each of the recessed grooves 7*b*. A lower face of the lower ferrite member 4*b* is held in contact with a bottom face 3*b* of the earthing block 3.

The dielectric substrate 5 is so disposed as to cover upper faces of the ferrite assembly 4 and the earthing block 3. An earthing electrode 5*a* is formed on the whole lower face of the dielectric substrate 5 so as to be held in contact with the upper face of the upper ferrite member 4*a*. In addition, the earthing electrode 5*a* is short-circuited to the bottom plate 2*a* through the earthing block 3. Circuit elements such as a capacitive line, a distributed constant line, etc. are formed on an upper face of the dielectric substrate 5 so as to constitute capacitor electrodes 10*a*, 10*b* and 10*c* for impedance matching. A through-hole 11 for receiving the lead-out portion 8d of each of the central conductors 8a, 8b and 8c is formed at a central portion of each of the capacitor electrodes 10a, 10b and 10c. Thus, an upper end of the lead-out portion 8d of each of the central conductors 8a, 8b and 8c is passed through the through-hole 11 of a corresponding one of the capacitor electrodes 10a, 10b and 10c so as to be connected to each of the capacitor electrodes 10a, 10b and 10c. Also, the lead-out portion 8d is spaced away from the earthing electrode 5a. Furthermore, an external terminal 12 is connected to each of the capacitor electrodes 10b and 10c, while a film resistor 13 is connected to the remaining capacitor electrode 10a. The capacitor electrode 10a is connected, through the film resistor 13, to the earthing electrode 5a of the dielectric substrate 5 by an earthing through-hole electrode 14. Alternatively, it can also be so arranged that the dielectric substrate 5 is provided oppositely to the arrangement of FIGS. 5 and 6 such that the earthing electrode 5a confronts the permanent magnet 6. Finally, the isolator K1 is fixed, by a pair of mounting lugs 15, to a chassis by using machine screws.

Now the operational effects of the isolator K1 are described. The isolator K1 of this embodiment is provided between a transmitter and a duplexer of a mobile telephone system and has a function of preventing both reflection of transmitted RF power and the entry of unnecessary radio waves into the transmitter. In the isolator K1 of the first embodiment, since the dielectric substrate 5 is provided on the ferrite assembly 4 and the lead-out portions 8d of the central conductors 8a, 8b and 8c are, respectively, connected to the capacitor electrodes 10a, 10b and 10c provided on the upper face of the dielectric substrate 5, the surface area of the dielectric substrate 5 is reduced as compared with that of a prior art isolator in which the capacitor electrodes are formed outwardly of an outer peripheral edge of the ferrite assembly and thus, the isolator K1 can be made compact. When the isolator according to the first embodiment of the present invention is compared with the prior art isolator provided with a ferrite assembly having a diameter identical with that of the isolator of the present invention, the length of each of the sides of the casing 2 is reduced to less than about two-thirds of that of the prior art isolator and the volume of the casing 2 is reduced by about 60%.

In the above described embodiment, the dielectric substrate 5 is provided on the ferrite assembly 4. However, it can also be so arranged that the positional relation of the dielectric substrate 5 and the ferrite assembly 4 is reversed such that the ferrite assembly 4 is provided on the dielectric substrate 5.

Figure 1:
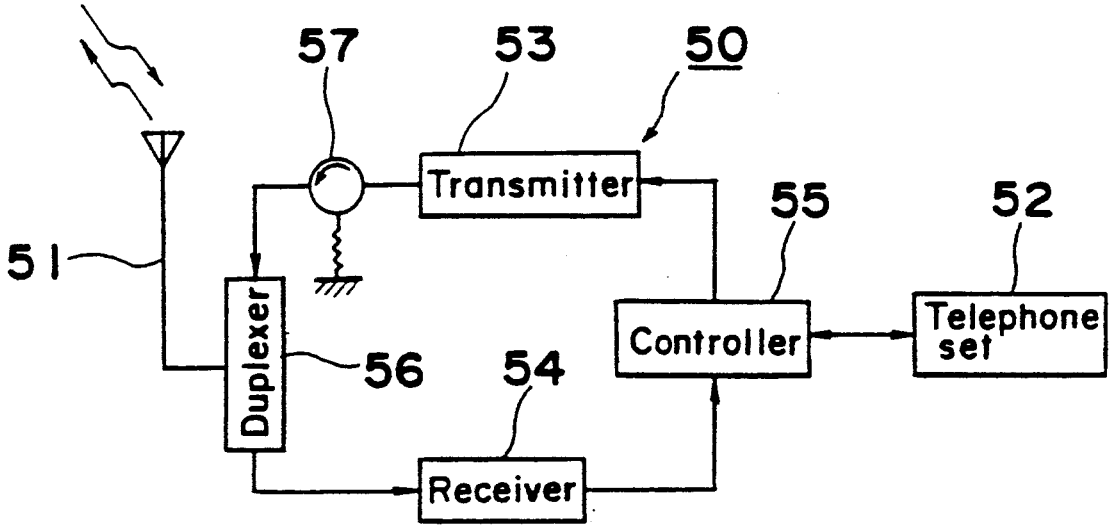
Fig. 1 PRIOR ART
FIG. 1 is a block diagram of a prior art mobile telephone system (already referred to)
Figure 4:
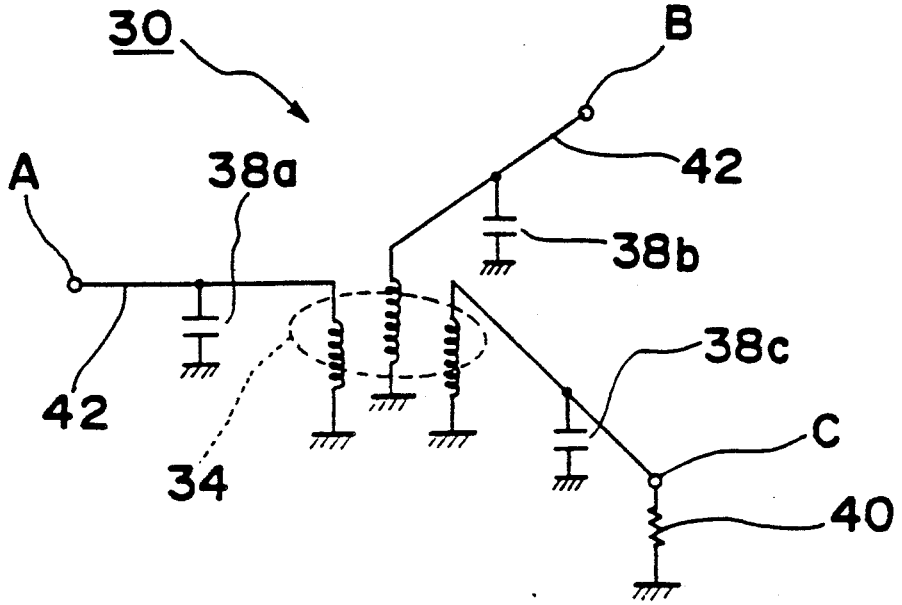
Fig. 4 PRIOR ART
FIG. 4 is a schematic diagram of an equivalent circuit of the prior art isolator of FIG. 2 (already referred to)
Figure 2:
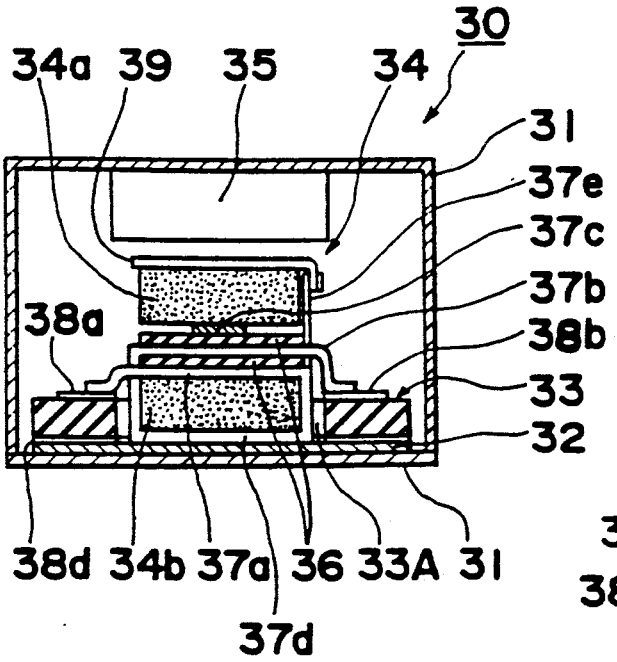
Fig. 2 PRIOR ART
FIG. 2 is a sectional view of a prior art isolator (already referred to)
Figure 3:
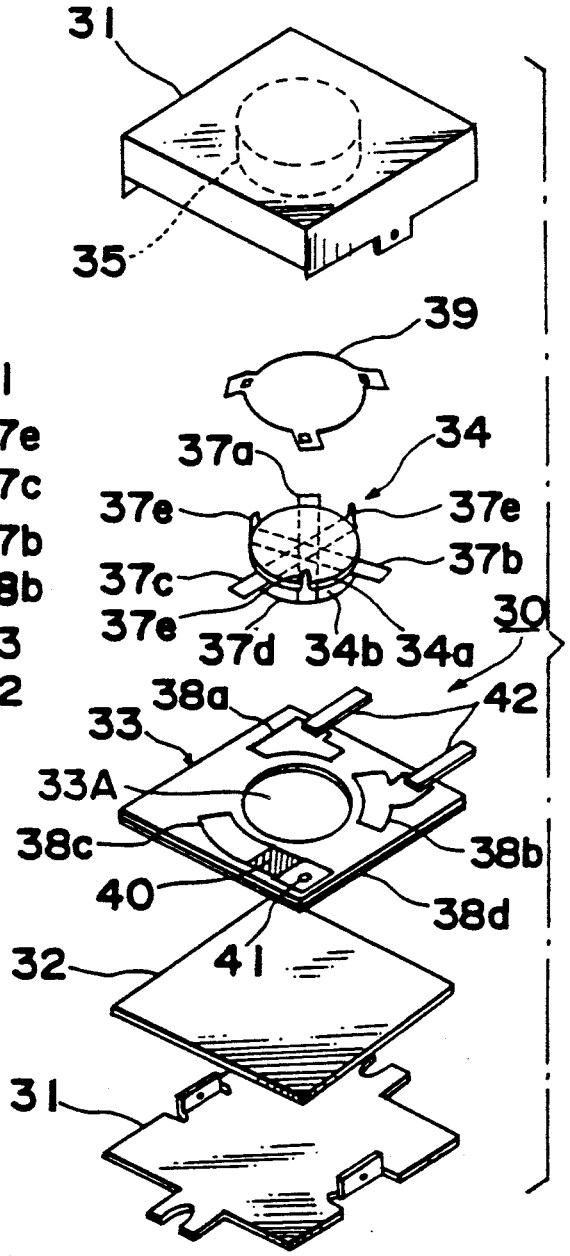
Fig. 3 PRIOR ART
FIG. 3 is an exploded perspective view of the prior art isolator of FIG. 2 (already referred to)

In the above described first embodiment, since the earthing electrode 5a of the dielectric substrate 5 is brought into contact with the upper face of the upper ferrite member 4a either directly or indirectly through the dielectric substrate 5 itself, etc. and the earthing electrode 5a is short-circuited to the bottom plate 2a by the earthing block 3 so as to assume the earth potential, a hitherto necessary earth plate (element 39 in FIG. 2) can be eliminated. That is, since the earthing face of the ferrite assembly 4 and a portion of the earthing electrode 5a of the dielectric substrate 5 are so set as to be used in common, the number of the components of the isolator can be reduced accordingly.

Furthermore, in this embodiment, the capacitor electrodes 10a, 10b and 10c are disposed above the ferrite assembly 4. Thus, in the case where the characteristics of the capacitor electrodes 10a, 10b and 10c are to be adjusted by trimming the capacitor electrodes 10a, 10b and 10c, this adjustment can be performed easily by removing the cover portion 26. Hence, an inconvenience of the prior art isolator can be eliminated. In the prior art isolator, since the capacitor electrodes are disposed below the upper face of the upper ferrite member, a trimming tool is likely to bump against the ferrite assembly, etc. so as to damage the ferrite assembly, etc. in some cases, so that it is difficult to perform trimming of the capacitor electrodes.

Figure 7:
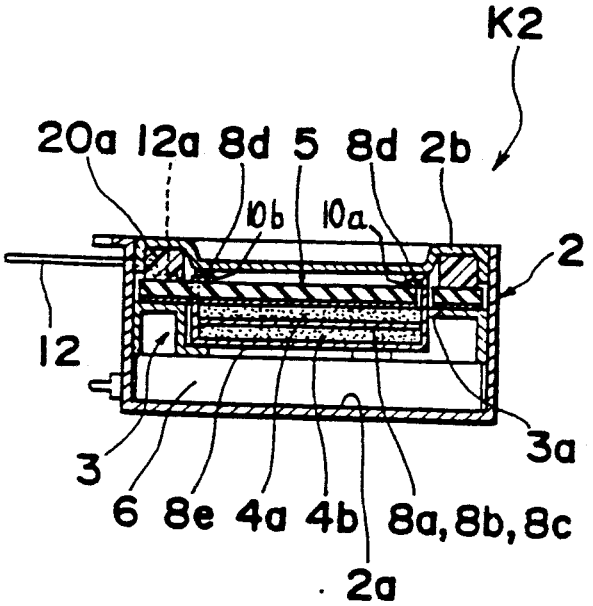
FIGS. 7 and 8 are views similar to FIGS. 5 and 6, respectively, particularly showing a second embodiment of the present invention.
Figure 8:
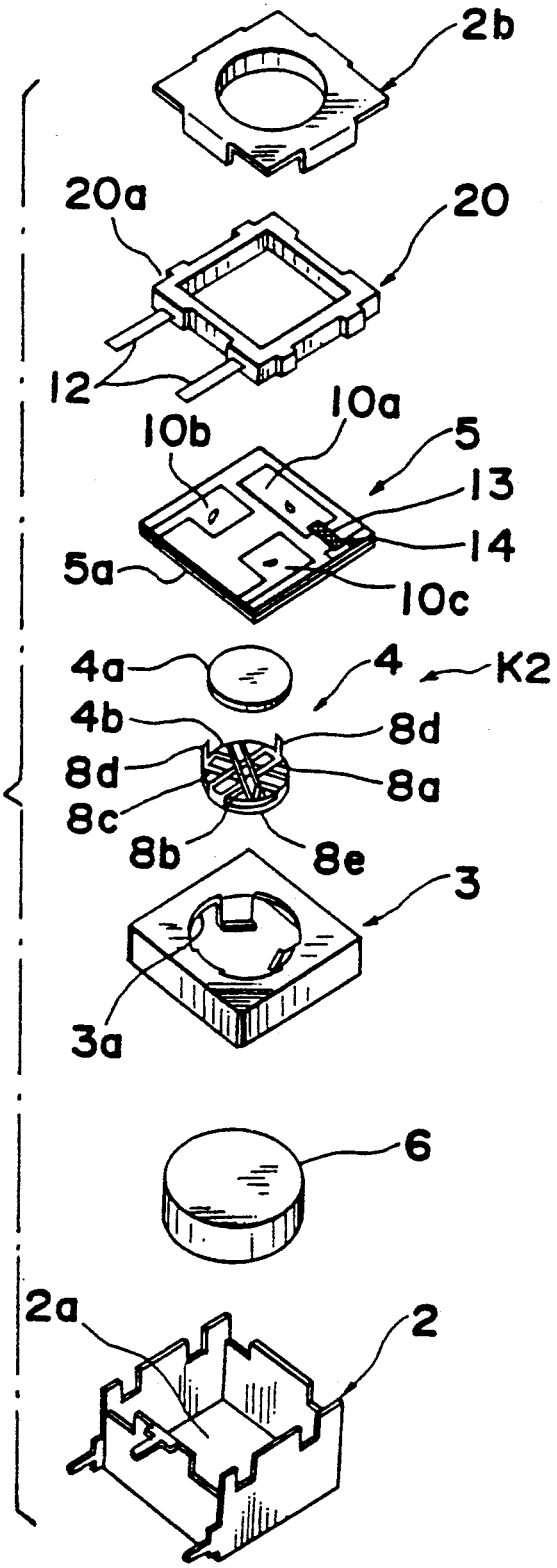

Referring further to FIGS. 7 and 8, there is shown an isolator K2 according to a second embodiment of the present invention. In the isolator K2, the permanent magnet 6 is placed on the inner face of the bottom plate 2a of the casing 2 made of a magnetic metal. Namely, in the isolator K2, the earthing block 3 made of a sheet metal is provided on the permanent magnet 6 placed on the bottom plate 2a and the ferrite assembly 4 is inserted into the central hollow 3a of the earthing block 3. The ferrite assembly 4 includes upper and lower ferrite members 4a and 4b, and central conductors 8a, 8b and 8c interposed between the upper and lower ferrite members 4a and 4b, as in the isolator K1. The dielectric substrate 5 having the capacitor electrodes 10a, 10b and 10c formed thereon is stacked on the ferrite assembly 4. Furthermore, a terminal block 20 having a shape of a square frame and made of synthetic resin is placed on the upper face of the dielectric substrate 5 and the cover portion 2b is mounted on the upper portion of the casing 2. Except for the position of the permanent magnet 6, the isolator K2 has an arrangement substantially similar to that of the isolator K1. As one example of the terminal block 20, the terminal block 20 includes a support member 20a made of an insulating material and a pair of the metallic terminals 12. As shown in FIG. 8, the support member 20a is formed such that an outer peripheral edge of the support member 20a corresponds to an inner peripheral edge of the casing 2. One end portion 12a of each of the terminals 12 is secured to the support member 20a. The terminal block 20 is press fitted into the casing 2 so as to depress the dielectric substrate 5 downwardly. Furthermore, as seen in FIG. 7 one end portion 12a of each of the terminals 12 is bent to form an L-shaped portion and is embedded in the support member 20a. The one end portion 12a is exposed to a lower face of the support member 20a and this exposed portion of a respective one of the terminals 12 is connected to each of the capacitor electrodes 10b and 10c.

Now the operational effects of the isolator K2 are described. In the isolator K2, since the dielectric substrate 5 is stacked on the ferrite assembly 4, the horizontal area of the dielectric substrate 5 is reduced, so that the isolator K2 is made compact and thus, the same effects as those of the isolator K1 can be achieved.

Furthermore, in the isolator K2, since the permanent magnet 6 is placed on the bottom plate 2a of the casing 2, it becomes possible to easily adjust the frequency characteristics of the isolator K2 after its assembly. This is because the cover portions 2b of any quantity of the isolators can all be made interchangeable. That is, in the case where the frequency characteristics are to be adjusted after assembly of the isolator K2, the cover portion 2b is initially removed and then, the capacitor electrodes 10a, 10b and 10c are trimmed. Since the individual permanent magnets 6 which are provided in respective the isolators K2, respectively have different magnetic forces, the frequency characteristics of the isolators must be adjusted in accordance with the magnetic forces of the respective permanent magnets 6. A problem arises in that, when adjusting the frequency characteristics, if the permanent magnet 6 is bonded to the inner face of the cover portion 2b, the casing 2 and the cover portion 2b should not be interchanged with those of another isolator. As a result, when the frequency characteristics of a number of the isolators are to be sequentially adjusted, close attention must be paid such that the cover portions 2b of the respective individual isolator are not lost, thereby resulting in low working efficiency. On the other hand, in the isolator K2, since the permanent magnet 6 is accommodated in the casing 2, any one of the cover portions 2b can be combined with an arbitrary one of the casings 2, so that the above described problem does not arise.

Moreover, in the case where the permanent magnet 6 is bonded to the cover portion 2b, the permanent magnet 6 is beforehand bonded to the cover portion 2b in another process and then, the cover portion 2b having the permanent magnet 6 bonded thereto is mounted on the casing 2 after assembly of the components. On the contrary, in the isolator K2, since the permanent magnet 6 can be bonded to the bottom plate 2a during assembly of the components, the additional process referred to above can be eliminated, thus resulting in reduction of the number of the manufacturing processes.

In addition, in the isolator K2, since the terminals 12 are secured to the support member 20a and are brought into contact with the capacitor electrodes 10b and 10c by bonding, the distance between the terminals 12 can be secured accurately and the operation of connecting the terminals 12 to the capacitor electrodes 10b and 10c does not require seperate positioning of each of the terminals 12, so that the number of manufacturing processes can be reduced, thus resulting in improvement of productivity.

In the above described first and second embodiments, the present invention has been described with respect to the isolator employed in the mobile telephone equipment of the mobile telephone set. However, the present invention is not limited to the isolator but, needless to say, can also be applied to a circulator, and to a nonreciprocal circuit element employed in high-frequency elements of other apparatuses.

As is clear from the foregoing description, in the nonreciprocal circuit element of the present invention, since the dielectric substrate having the impedance matching electrodes and the earthing electrode formed thereon, and the ferrite assembly, are stacked, the area of the dielectric substrate can be reduced as compared with the known arrangement in which the impedance matching electrodes are formed outwardly of the outer peripheral edge of the ferrite assembly and thus, the isolator can be made compact.

Furthermore, in accordance with the present invention, since the hitherto necessary earth plate can be eliminated, the number of components of the isolator can be reduced.

Although the present invention has been fully described by way of example with reference to the embodiments shown in the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A nonreciprocal circuit element comprising:

a ferrite assembly which includes at least one ferrite member and a plurality of central conductors;

said central conductors being electrically insulated from each other while intersecting with one another in an axial direction of said ferrite assembly;

said central conductors each having a lead-out portion and an earthing portion; and a dielectric substrate which has an earthing electrode formed on one face thereof and conductively connected to said at least one ferrite member, and has a plurality of impedance matching electrodes formed on the other face thereof;

said ferrite assembly and said dielectric substrate being stacked in said axial direction and substantially coextensive, in a radial direction, within an imaginary cylinder closely surrounding said ferrite assembly and said dielectric substrate, with said lead-out portions of said central conductors being, respectively, connected to said impedance matching electrodes and extending from said ferrite assembly to said impedance matching electrodes, said lead-out portions defining said imaginary cylinder;

said earthing portions of said central conductors and said earthing electrode of said dielectric substrate being grounded; and magnetic means applying a direct current magnetic field to said ferrite assembly.

2. A nonreciprocal circuit element as claimed in claim 1, said magnetic means including a permanent magnet disposed for producing the direct current magnetic field.

3. A nonreciprocal circuit element as claimed in claim 2, further including a casing accommodating said ferrite assembly, said dielectric substrate and said permanent magnet, said permanent magnet being provided at a portion of said casing such that said dielectric substrate is disposed between said ferrite assembly and said permanent magnet.

4. A nonreciprocal circuit element as claimed in claim 2, further including a casing accommodating said ferrite assembly, said dielectric substrate and said permanent magnet, said permanent magnet being provided at a portion of said casing such that said ferrite assembly is disposed between said permanent magnet and said dielectric substrate.

5. A nonreciprocal circuit element comprising:

a ferrite assembly which defines an axial direction and a radial direction and includes first and second ferrite bodies; three central conductors, said central conductors extending radially of said ferrite assembly and intersecting each other at substantially equal angles, at a location axially between the ferrite bodies;

each said central conductor having a lead end and a ground end diametrically at opposite peripheries of said ferrite assembly, respectively; said central conductors being insulated from each other in said axial direction between said ferrite bodies;

a dielectric substrate having a grounding plate formed on an axially inner face thereof adjacent to and conductively contacting said first ferrite body; and having three capacitive electrodes formed on the axially outer face thereof;

grounding block means conductively contracting said second ferrite body and having a radially outward extension portion closely surrounding said ferrite assembly and extending axially to said grounding plate on the axially inner face of the dielectric substrate;

lead means connected respectively to said lead ends of said central conductors and extending therefrom in an axial direction to respective capacitive electrodes on the axially outer face of the dielectric plate; said lead means being radially within said extension portion of said grounding block means and passing through apertures defined in said grounding plate and said dielectric substrate to reach said capacitive electrodes; and means for dissipating a signal supplied by one of said lead means to its respective capacitive electrode;

casing means conductively connected to said grounding block means; and a magnet disposed in said casing means for applying a direct current magnetic field to said ferrite assembly.

6. A nonreciprocal circuit element as claimed in claim 5, wherein said magnet is a permanent magnet.

7. A nonreciprocal circuit element as claimed in claim 5, wherein said magnet is disposed within said casing means axially facing said capacitive electrodes.

8. A nonreciprocal circuit element as claimed in claim 5, wherein said magnet is disposed within said casing means axially facing said grounding block means.

9. A nonreciprocal circuit element as claimed in claim 8, wherein said magnet is in conductive contact with said grounding block means and said casing means.

10. A nonreciprocal circuit element as claimed in claim 5, wherein said dissipating means comprises a resistance which interconnects said one lead means to said grounding block means.

11. A nonreciprocal circuit element as claimed in claim 5, wherein the radial periphery of said dielectric substrate substantially corresponds to the radial periphery of said grounding block means; whereby said dielectric substrate and said grounding block means, and said ferrite assembly within the grounding block means, together constitute a compact internal assembly.

12. A nonreciprocal circuit element as claimed in claim 11, wherein said compact internal assembly closely corresponds in radial dimensions with said magnet; and with the inner periphery of a case which constitutes said casing means; whereby said case and its content constitute a compact overall assembly.

13. A nonreciprocal circuit element as claimed in claim 5, wherein said dielectric substrate and said two ferrite bodies are stacked in the axial direction; and are substantially coextensive radially; whereby they form a compact internal assembly.

14. A nonreciprocal circuit element comprising:

a ferrite assembly which defines an axial direction and a radial direction includes at least first and second ferrite bodies; a plurality of central conductors, said central conductors extending radially of said ferrite assembly and intersecting each other so as to define substantially equal angles, at at least one location axially between the ferrite bodies;

each said central conductor having a lead end and a ground end diametrically at opposite peripheries of said ferrite assembly, respectively; said central conductors being insulated from each other in said axial direction between said ferrite bodies;

a dielectric substrate having a grounding plate formed on an axially inner face thereof adjacent to and conductively contacting said first ferrite body; and having impedance-matching means at the axially outer face thereof;

grounding block means conductively contacting said second ferrite body and having a radially outward extension portion closely surrounding said ferrite assembly and extending axially to said grounding plate on the axially inner face of the dielectric substrate;

lead means connected respectively to said lead ends of said central conductors and extending therefrom in an axial direction to said impedance-matching means at the axially outer face of the dielectric plate; said lead means being radially within said extension portion of said grounding block means and passing through apertures defined in said grounding plate and said dielectric substrate to reach said impedance-matching means; and means for dissipating a signal supplied by one of said lead means;

casing means conductively connected to said grounding block means; and a magnet disposed for applying a direct current magnetic field to said ferrite assembly.

15. A nonreciprocal circuit element as claimed in claim 14, wherein said magnet is a permanent magnet.

16. A nonreciprocal circuit element as claimed in claim 14, wherein said magnet is disposed within said casing means axially facing said impendance matching means.

17. A nonreciprocal circuit element as claimed in claim 14, wherein said magnet is disposed within said casing means axially facing said grounding block means.

18. A nonreciprocal circuit element as claimed in claim 17, wherein said magnet is in conductive contact with said grounding block means and said casing means.

19. A nonreciprocal circuit element as claimed in claim 14, wherein said dissipating means comprises a resistance which interconnects said one lead means to said grounding block means.

20. A nonreciprocal circuit element as claimed in claim 14, wherein the radial periphery of said dielectric substrate substantially corresponds to the radial periphery of said grounding block means; whereby said dielectric substrate and said grounding block means, and said ferrite assembly within the grounding block means, together constitute a compact internal assembly.

21. A nonreciprocal circuit element as claimed in claim 20, wherein said compact internal assembly closely correspond in radial dimensions with said magnet; and with the inner periphery of a case which constitutes said casing means; whereby said case and its contents constitute a compact overall assembly.

22. A nonreciprocal circuit element as claimed in claim 14, wherein said dielectric substrate and said two ferrite bodies are stacked in the axial direction; and are substantially coextensive radially; whereby they form a compact internal assembly.

* * * * *